US010058763B2

(12) United States Patent
Bombard et al.

(10) Patent No.: US 10,058,763 B2
(45) Date of Patent: Aug. 28, 2018

(54) TELEMARK SKI BINDINGS SYSTEMS AND METHODS

(71) Applicant: David L. Bombard, Edwards, CO (US)

(72) Inventors: David L. Bombard, Edwards, CO (US); Fintan Doyle, Silverthorne, CO (US)

(73) Assignee: Bishop Bindings LLC, Edwards, CO (US)

( * ) Notice: Subject to any disclaimer, the term of this patent is extended or adjusted under 35 U.S.C. 154(b) by 0 days.

(21) Appl. No.: 14/699,330

(22) Filed: Apr. 29, 2015

(65) Prior Publication Data

US 2016/0317900 A1 Nov. 3, 2016

(51) Int. Cl.

| | |
|---|---|
| ***A63C 1/04*** | (2006.01) |
| ***A63C 9/20*** | (2012.01) |
| ***A63C 9/00*** | (2012.01) |
| *A63C 9/084* | (2012.01) |

(52) U.S. Cl.

CPC ..... *A63C 9/20* (2013.01); *A63C 9/006* (2013.01); *A63C 9/0844* (2013.01); *A63C 2009/008* (2013.01); *A63C 2201/06* (2013.01)

(58) Field of Classification Search

CPC .... A63C 9/20; A63C 9/00; A63C 9/02; A63C 9/06; A63C 2201/06; A63C 2009/008

See application file for complete search history.

(56) References Cited

U.S. PATENT DOCUMENTS

| | | | | | |
|---|---|---|---|---|---|
| 4,152,009 | A * | 5/1979 | Schmid | A63C 9/0807 | 280/614 |
| 4,174,122 | A * | 11/1979 | Gorlach | A63C 9/20 | 280/615 |
| 4,558,884 | A * | 12/1985 | Guitel | A63C 9/082 | 280/620 |
| 4,887,833 | A * | 12/1989 | Bailey | A43B 5/0492 | 280/615 |
| 5,333,892 | A * | 8/1994 | Stritzl | A63C 9/0805 | 280/625 |
| 5,558,353 | A * | 9/1996 | Arduin | A63C 9/00 | 280/602 |
| 5,636,855 | A * | 6/1997 | Couderc | A63C 5/07 | 280/602 |
| 5,794,962 | A * | 8/1998 | Bardin | A63C 9/005 | 280/607 |
| 6,431,578 | B2 * | 8/2002 | Pedersen | | 280/613 |
| 6,986,526 | B2 * | 1/2006 | Haughlin | A63C 9/20 | 280/613 |
| 7,210,698 | B2 * | 5/2007 | Dandurand | A63C 9/20 | 280/614 |
| 7,246,812 | B1 * | 7/2007 | Ayliffe | A63C 9/20 | 280/615 |
| 7,264,263 | B2 * | 9/2007 | Riedel | A63C 9/20 | 280/614 |

(Continued)

*Primary Examiner* — James M Dolak

(74) *Attorney, Agent, or Firm* — James Conte; Ladas & Parry

(57) ABSTRACT

The present invention relates to a ski binding used in telemark skiing. An exemplary system maintains a toe of a ski boot in association with a ski while permitting a heel of the ski boot to elevate to a top surface of the ski. The binding system comprises several complex subsystems, such as a toe mating mechanism, a toe plate system, a base plate system, a heel fastening mechanism, a sliding plate system, and rail system.

10 Claims, 18 Drawing Sheets

(56) References Cited

U.S. PATENT DOCUMENTS 7,401,802 B2 * 7/2008 Walker ..... A63C 9/02
280/614
7,451,997 B2 * 11/2008 Hauglin ..... A63C 9/20
280/614
7,458,598 B2 * 12/2008 Giffin ..... A63C 9/02
280/605
7,556,280 B2 * 7/2009 Holzer ..... A63C 9/02
280/11.3
7,681,905 B2 * 3/2010 Hauglin ..... A63C 9/0807
280/611
7,735,851 B2 * 6/2010 Shute ..... A63C 7/1026
280/613
8,167,331 B2 * 5/2012 Wollo ..... A63C 9/02
280/619
8,328,225 B2 * 12/2012 Prigge ..... A63C 9/006
280/614
8,534,697 B2 * 9/2013 Lengel ..... A63C 9/06
280/617
8,876,123 B2 * 11/2014 Bradshaw ..... A63C 1/04
280/11.3
9,016,713 B2 * 4/2015 Wollo ..... A63C 9/02
280/614
9,033,359 B2 * 5/2015 Favret ..... A63C 9/00
280/613
9,452,343 B2 * 9/2016 Schroer ..... A63C 9/007
9,526,972 B2 * 12/2016 Steinke ..... A63C 9/006
9,566,498 B2 * 2/2017 Holm ..... A63C 9/20
9,713,758 B2 * 7/2017 Lefsrud ..... A63C 9/002
9,795,862 B2 * 10/2017 Soldan ..... A63C 9/20
2003/0168830 A1 * 9/2003 Haughlin ..... A63C 9/20
280/615
2003/0189315 A1 * 10/2003 Venable ..... A63C 9/02
280/616
2006/0087102 A1 * 4/2006 Coles ..... A63C 9/02
280/626

* cited by examiner

TELEMARK SKI BINDINGS SYSTEMS AND METHODS

BACKGROUND OF THE INVENTION

Field of the Invention

The present invention relates in certain embodiments to binding systems. More particularly, embodiments of the invention relate to a ski or snowboard binding used in telemark skiing. An exemplary system utilizes a system to maintain a toe of a ski boot in association with a ski while permitting a heel of the ski boot to elevate to a top surface of the ski.

Description of the Related Art

Bindings for telemark skis and cross-country skis provide an interface between a ski boot and a ski that permits a skier to elevate the heel of the ski boot with respect to the top surface of the ski while skiing. This type of turn is called a "telemark" or "free-heel" turn. Telemark ski bindings are used with boots that are capable of flexing in the metatarsal region. This permits the heel of the boot to lift when walking or during the performance of a "telemark turn" when sliding downhill. Traditionally, the toe piece is fixed to the top of the ski and does not move relative to the ski. The flex of the boot enables the boot heel to be raised or lowered relative to the ski surface. Such boots vary in the restriction of flex and require more or less energy to be expended by the user to achieve the same angle of flex.

Traditional binding systems include the aforementioned toe portion, such as a toe box or maintaining the toe of the boot in a fixed position. A tension cable, passed around the heel, is typically connected to a tensioning mechanism for fixing the boot toe to the toe iron such that during skiing the boot heel and the heel of the skiers foot may be raised in an arc away from the ski. The cable may incorporate elastic elements, a length adjustment mechanism, and/or a tightening mechanism that vary the effective length of the cable while maintaining tension against the boot.

A cable or other flexible linkage, extending from the binding toe piece for engagement with a heel portion of the ski boot, has been used to increase heel stability in some prior art designs. The linkage can hold the toe of the ski boot firmly in place in the toe piece. The cable or linkage typically locates a toggling heel piece in engagement with a feature at the heel of the ski boot. Most commonly, the user must manually actuate the heel piece to engage the ski boot in the binding.

Some telemark bindings pivotally mount to the ski which allows for greater freedom and ease of movement while walking and climbing. However, for downhill movement, it is preferable that the toe piece is fixed relative to the upper ski surface and not pivot. Several mechanisms have been proposed which enable the user to alternate between a free-pivot orientation for use during touring, and a locked position for use during downhill movement.

Various features and systems are incorporated into the binding depending on the specific activity for which they are designed. These features may include states of operation, releasable responses, switching mechanisms, and various response characteristics. States of operation refer to a feature in which a binding may be configured to switch between different functions or states of operation that provide independent characteristics, such as a free pivoting touring state and a restrained locked ski state. Releasable responses refer to various releasable mechanisms incorporated in the binding, such as a mechanism to automatically disengage a boot from a ski in response to a force. Switching mechanisms refer to systems that switch or change control of certain characteristics of a binding, such as a mechanism that enables the user to increase biasing force or switch between states of operation. Response characteristics refer to any type of response from the user that changes performance characteristics, such as a transfer of force from the user's foot to the binding platform.

SUMMARY OF THE INVENTION

The present invention relates to a ski binding used in telemark skiing. An exemplary embodiment utilizes a system to maintain a toe of a ski boot in association with a ski while permitting a heel of the ski boot to elevate to a top surface of the ski. The binding system comprises several complex subsystems, such as a toe mating mechanism, a toe plate system, a base plate system, a heel fastening mechanism, a sliding plate system, and rail system.

In one preferred embodiment, the toe mating mechanism 010 is optimized to eliminate the "elf toe" or "rocker launch" effect caused by conventional telemark boot and binding systems. This effect occurs when there is a fixed restraining mechanism for the toe of the boot, such as a sheet metal toe box. Current telemark boots are made with a plastic shell that allows the boot to flex near the metatarsal region of the foot with a bellows-like configuration of the plastic. These bellows features can cause the toe of the boot to create an angle with the heel of the boot, especially after many cycles of flexing, causing an "elf toe" effect. As the term suggests, "elf toe" describes the condition when the distal tip of the toe portion of the boot is angled upward with respect to the length of the boot giving the visual impression of an elf boot. The bellows eventually plastically deform, take a set ("rocker") and thus create an angle between the toe portion and heel portion of the boot. When the toe of such a boot is inserted into a fixed restraining mechanism, the heel will lift off the back of the ski. This causes a force to be applied at the user's heel in the direction of and parallel to the front of the ski, and thus may give the user the sensation of getting "launched" over the front of the ski. The toe mating mechanism 010 of the preferred embodiment eliminates this "rocker launch" by not being rigidly fixed to the ski. It is allowed to rotate on an axis parallel to the axis that the boot flexes. This mechanism allows the toe to lift up and keeps the heel of the boot firmly on the ski when the user is standing and varies the amount of force and moment that is exerted on the ski at a given angle of the bellows or boot flex. A key feature of this mechanism is that the axis of rotation of the toe bail is coincident to the axis of the base plate mechanism which allows the forward flex of the boot during the telemark turn. Another feature of this mechanism is that the bail is formed of round material that does not damage or deform the boot material (typically plastic). This increases the life of the boot and also allows the boot to be more easily removed from the binding system. Also, in this system the space between the bottom of the toe and the top of the binding can be removed and adjusted with various sized spacers or wedge shaped components that can be added to the system. Adjusting this space can allow the user to customize the timing and amount of force applied from the boot to the ski through the binding.

In accordance with another embodiment, the sliding plate system is designed to improve lateral edge control and the transfer of torsional and rotational forces to the ski during skiing. Lateral edge control is the ability of the user to apply force to the lateral edge of the ski while turning in a precise and controlled manner in order to control the lateral pivoting of the ski edge, and thus controlling the force exerted by the ski's edge into the snow surface during skiing. The degree of lateral edge control comes from the transmission of forces from the lower leg and foot to the ski through the boot and binding mechanism. Torsional force transfer is the ability of the binding to transfer torsional forces from the foot and boot to the ski to allow the ski to quickly and efficiently be tilted up on an edge for turning or stopping during skiing. Rotational forces are also used to turn and control the ski and the sliding plate system improves the transfer of these forces from the foot, through the boot, then through the binding to the ski. The sliding plate system of the present invention connects the boot to the ski through a series of rigid components versus the flexible components of conventional embodiments. This allows compressive, tensile, torsional and rotational force to be transmitted from the boot to the binding and then to the ski or snowboard. Conventional cable-based or wire-based systems cannot transmit compressive or torsional forces as efficiently from the heel of the boot due to the inherent mechanics of a bendable cable or wire, so they rely predominately on the boot for the torsional rigidity to translate forces laterally and rotationally and thus put the ski on edge for turning or stopping.

In accordance with another embodiment, the toe plate system comprises a moveable customizable pivot for variable "active feel" or flex by the user. This system allows the user to change the amount of force the boot exerts on the ski at the same angle of bellow and boot flex. The toe bail system is customizable by permitting the user to change the toe bail pivot position with respect to the ski to decrease ("soften") or increase ("stiffen") the transfer of forces from the boot to the ski by adjusting the position of the boot relative to the toe support system of the binding. Conventional telemark binding systems are not able to adjust the flex by the user, or do so through a mechanism that does not adjust the position of the boot relative to the toe support.

In accordance with another embodiment, the heel fastening mechanism comprises an interface of the top rail to the base plate system that further comprises a unique interface of the heel bail to the base plate system that increases control when the foot is down.

In accordance with another embodiment, the sliding plate system comprises components that are lightweight without sacrificing performance.

In accordance with another embodiment, the sliding plate system comprises precision bearings for smooth precise travel.

In accordance with another embodiment, the sliding plate system is shaped to help dislodge snow during skiing.

In accordance with another embodiment, the toe mating system is replaced with a "tech toe" that is typically used in conventional ski bindings systems known as "Alpine Touring" (AT) or "Randonee" ski binding systems. The tech toe mechanism enables a free pivot touring mode if the user disconnects the rear part of the binding for touring. The tech toe engages two pins with two corresponding receptacles at the toe of the boot. These receptacles are positioned to allow the boot to freely pivot at the toe while still being connected to the binding and thus to the ski. The user can re-connect the rear part for skiing downhill after climbing up-hill.

In accordance with another embodiment, the base plate system is fastened to the ski or snowboard and the sliding plate system, toe mating mechanism, toe plate system, and heel fastening systems can be easily removed and adjusted independently of the base plate system. This allows the use of multiple base systems that are permanently fastened to the ski or snowboard and a single bindings system to be easily transferred from one set of skis to another. This can reduce the cost by allowing a user to move one pair of bindings from one set of skis to another set of skis that may be more suitable for the current snow conditions. The base plate system and binding can be attached to a snowboard to allow a user to make smooth flexed foot turns with a snowboard. The front and back bindings are attached at various angles to the snowboard depending on user preference. The use of a single ski or snowboard in combination with the telemark or "free-heel" binding increases the degrees of freedom between the user and the ski or snowboard allow the user to execute different movements and reduces the impact forces by putting the user into a more athletic bent knee and foot stance.

BRIEF DESCRIPTION OF THE DRAWINGS

In order to better understand the invention and to see how it may be carried out in practice, some preferred embodiments are next described, by way of non-limiting examples only, with reference to the accompanying drawings, in which like reference characters denote corresponding features consistently throughout similar embodiments in the attached drawings.

FIG. 14A shows the ski representatively at 200.

DETAILED DESCRIPTION OF THE PREFERRED EMBODIMENTS

Figure 1A:
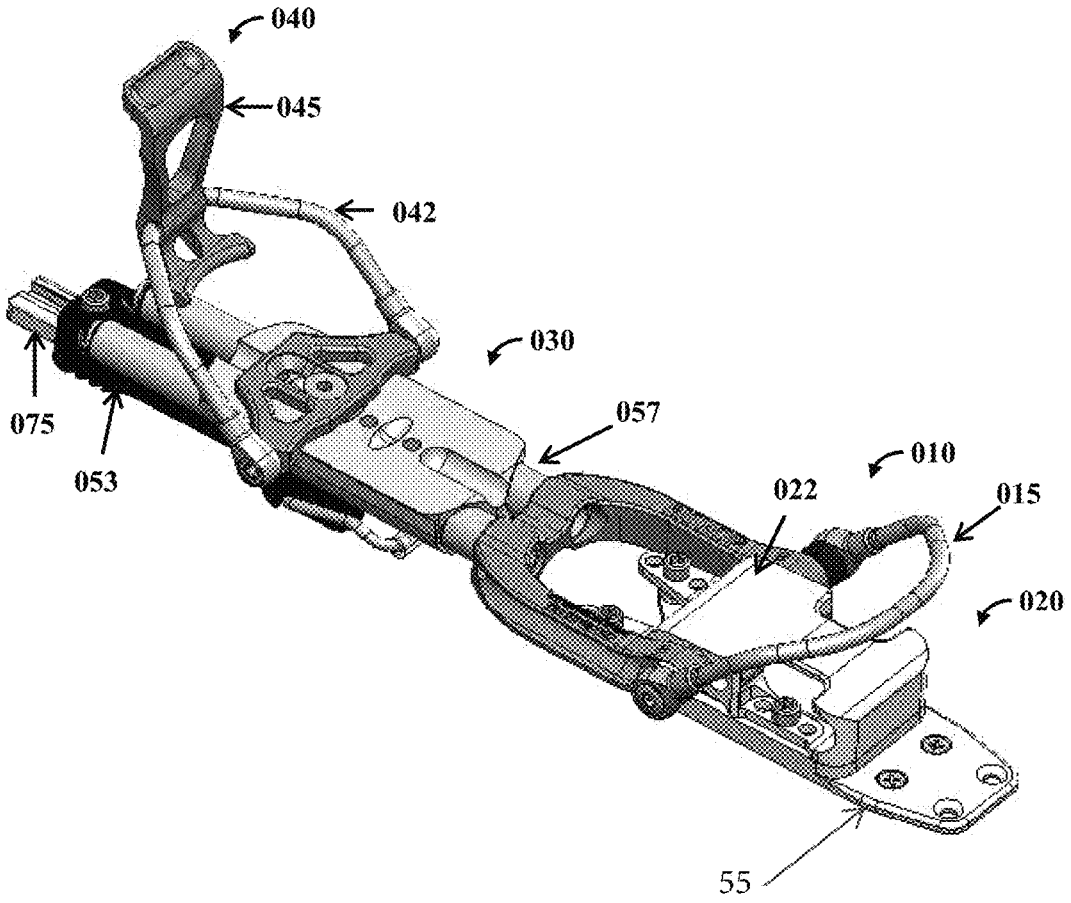
FIG. 1A is an isometric view of the invention in the down position
Figure 1B:
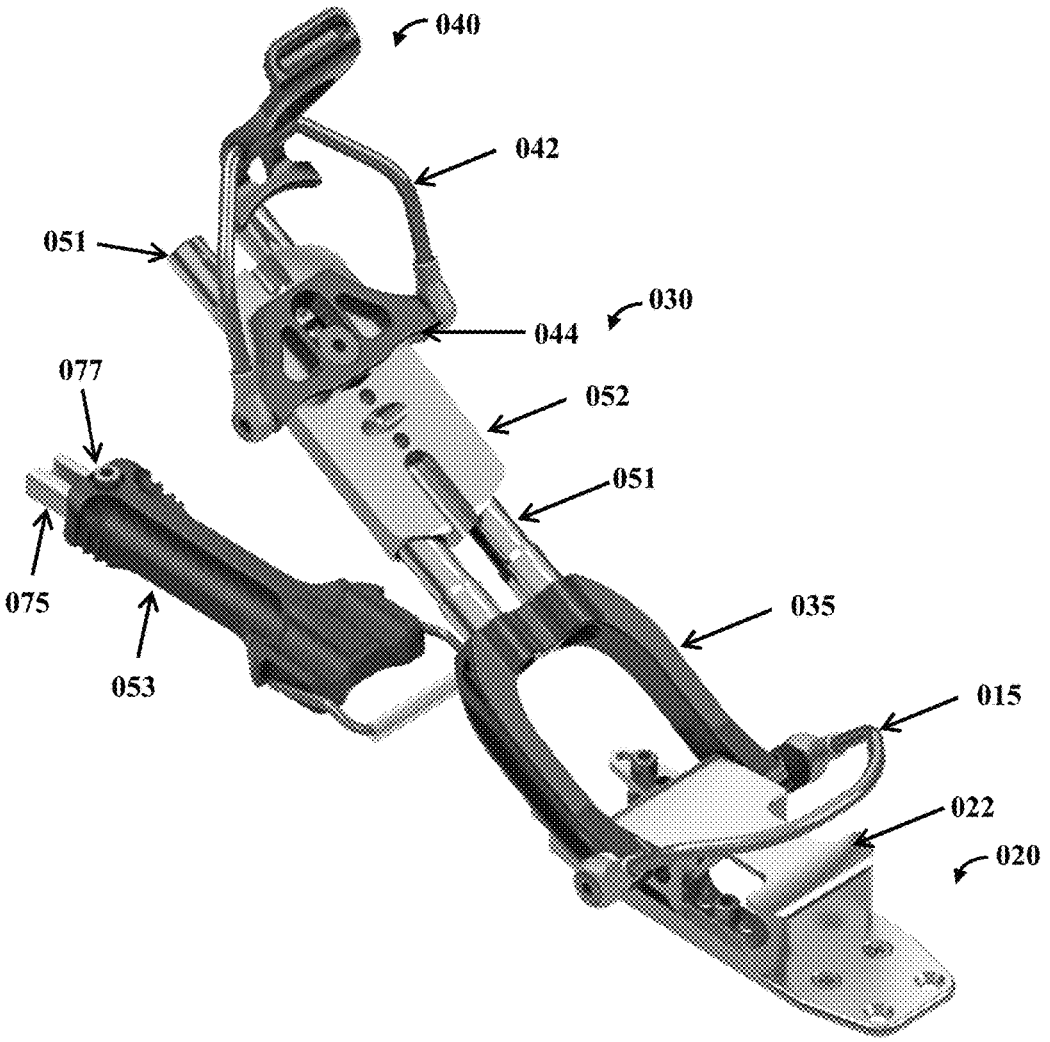
FIG. 1B is an isometric view of the invention in the up position
Figure 2:
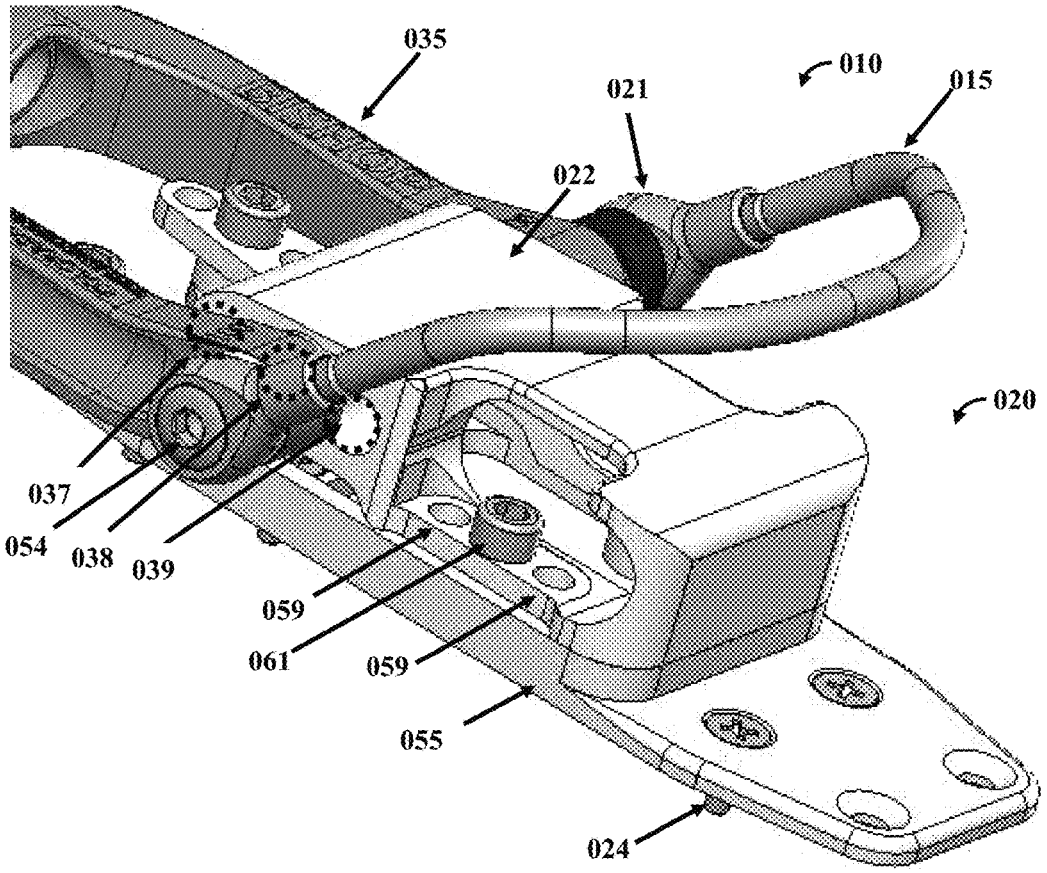
FIG. 2 is a detailed view of the toe bail region
Figure 3:
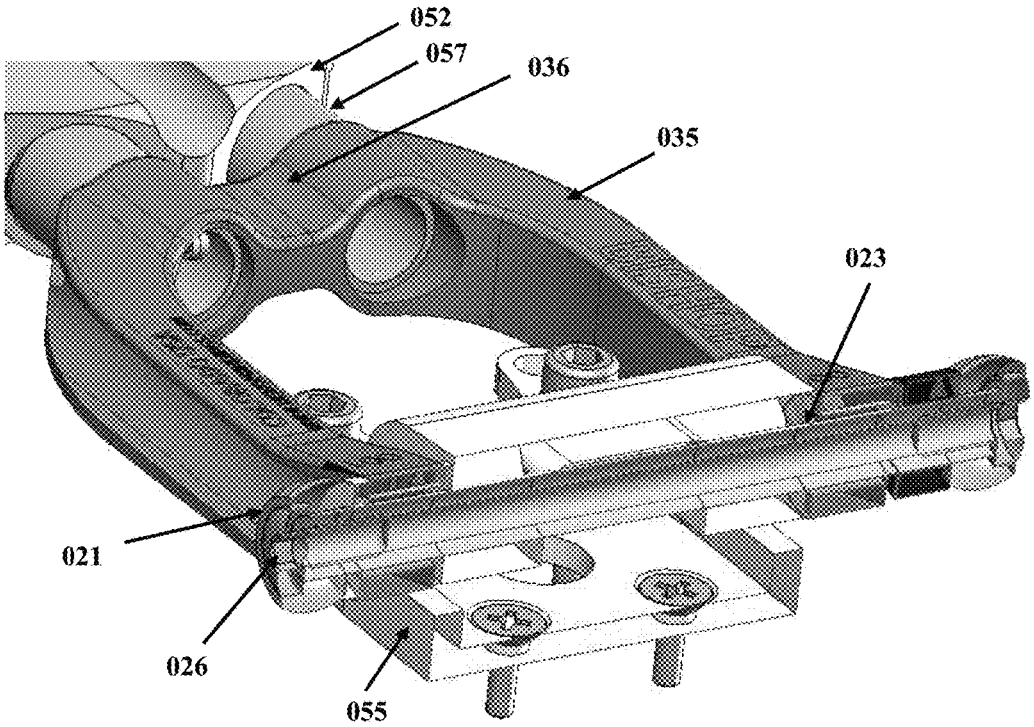
FIG. 3 is a detailed view, cross-section through the main pivot
Figure 4:
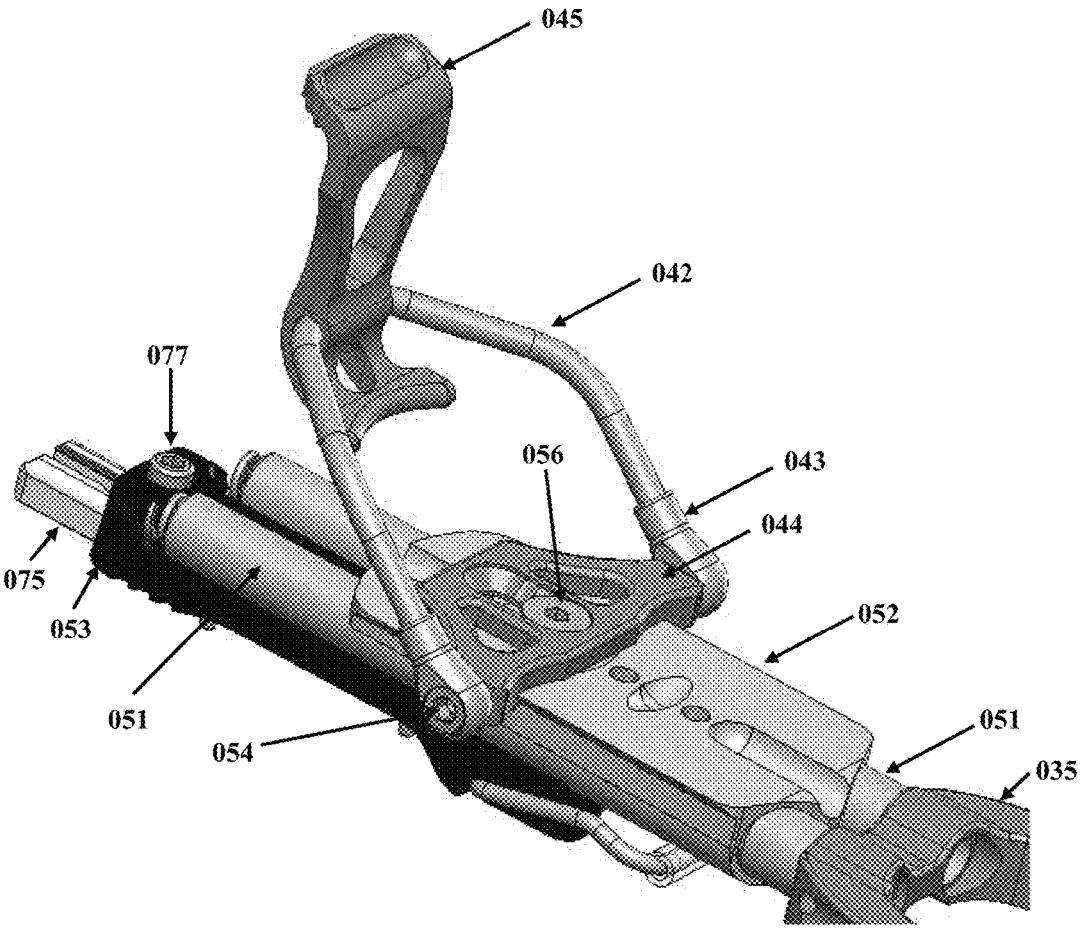
FIG. 4 is a detailed view of the heel fastening system region

In one preferred embodiment, the toe mating mechanism 010 comprises a toe bail 015 and knuckle 035 that pivots on the same axis. The toe bail 015 is rigidly connected to the toe lug 021, which pivots with respect to the toe block 022 along the longitudinal axis of the main pivot 023 at center of shoulder bolt 026. The toe block 022 is rigidly connected to the baseplate 055 at one of several locations through a hole 059 by fastener 061. Thus the position of the toe block 022 to the baseplate 055 is customizable to the user. This also allows the user to quickly and easily move the binding from one set of skis that have the baseplate 055 attached. The baseplate 055 is fastened to the top planar surface of the ski at several locations by screws 024 or other mechanical fasteners. Thus, the toe bail 015 rotates or pivots with respect to the top planar surface of the ski at the main pivot 023. The knuckle 035 rotates with respect to the toe block 022 about the same center of rotation of main pivot 023, and thus rotates with respect to the ski at the same center longitudinal axis of the shoulder bolt 026. Therefore the axis of rotation of the toe bail 015 is coincident to the axis of the sliding plate mechanism 030 which allows the forward (toward the toe) flex of the boot during the telemark turn and eliminates the "rocker launch" or "elf toe" effect".

Figure 10:
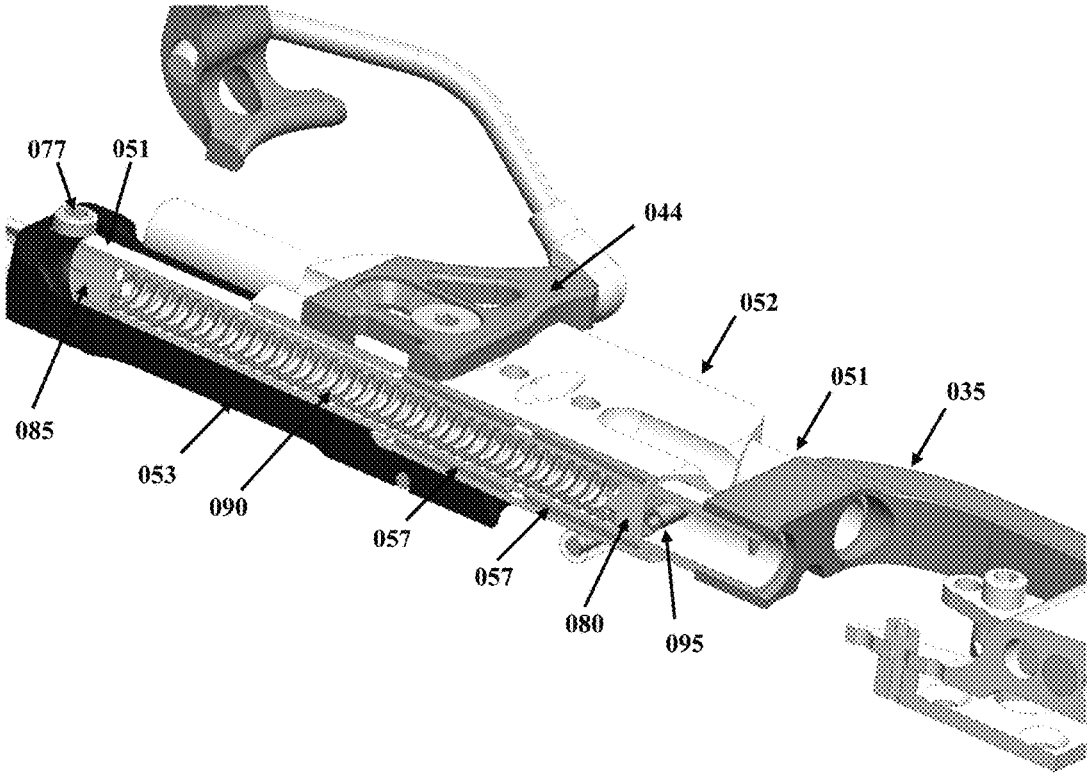
FIG. 10 is a cross sectional view of the assembly

In accordance with another embodiment, the toe plate system 020 is designed to improve lateral and torsional control of the ski. Lateral edge control is described as the ability of the skier to precisely control movement of the ski's lateral edge during a turn. The extent of lateral edge control comes from the efficiency of the transmission of forces from the lower leg and foot to the ski through the boot and binding mechanism. The sliding plate system 030 of the present invention connects the boot to the ski through a series of rigid components. The heel fastening mechanism 040 is fastened to the sole block 044 at the heel lug 043 via the shoulder bolt 054. The sole block 044 is rigidly attached to the rear case 052 with a fastener 056. The rear case 052 may translate along the longitudinal axis of the main tube 051 but precision bearing surfaces of the rear case bearing 057 prevent any lateral movement. The main tube 051 contains the main spring 090. The main spring 090 is constrained at the proximal location by the spring plug 080 and by the tube plug 085 distally as shown in FIG. 10. The rear case bearings 057 are fixed to the rear case 052 and maintain a precise smooth fit for longitudinal travel along the main tube's outer diameter to prevent lateral movement.

In accordance with another embodiment, the toe plate system 020 comprises a moveable customizable pivot 037, 038, and 039 to change the "activeness" of the system by the user. The forces exerted on the boot from the binding are transmitted from the toe plate system 020 to the boot via the toe bail 015 and toe block 022. The toe bail and sliding plate system 030 may be moved via the main pivot 023 at positions 037, 038 or 039. By changing the pivot position from 037 to 038, or to 039, the resultant forces imparted to the boot and thus the ski from the binding change and thus creates a customizable feel during free heel telemark skiing. "Feel" is meant to explain that the user can experience a change in responsiveness of the binding to the user's movement and thus generation of force on the binding. This is due to the fact that moving the main pivot 023 moves the toe of the boot relative to the front edge of the toe block 022. When the pivot is in the most forward position 039, a larger portion of the boot toe extends off the front edge of the toe plate. This causes a shorter moment arm between the main pivot 023 and the forward supported edge of the boot toe which results in a less force to flex the boot forward. This phenomenon is referred to as a "softer" or "less active" feel. Conversely, when the main pivot 023 is in the furthest posterior or back position 037, there is less of the boot toe hanging off the front edge of the toe block 022. This causes a larger moment arm between the main pivot 023 and the forward supported edge of the boot toe which results in a "stiffer" or "more active" feel.

Figure 14A:
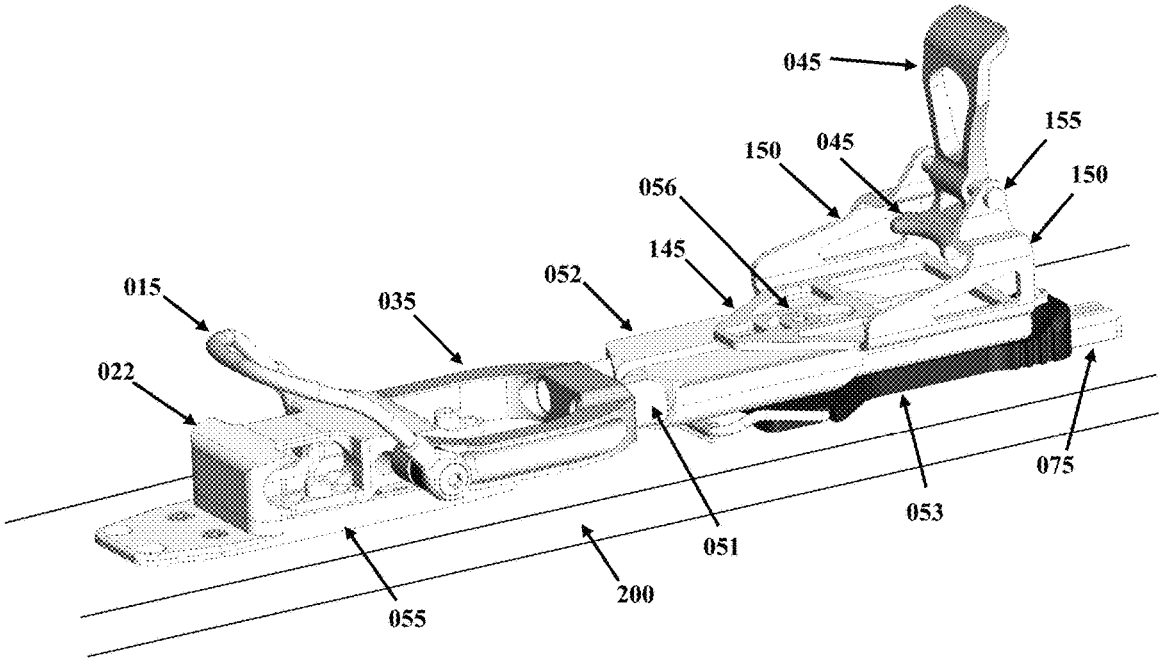
FIG. 14A-D are detailed views of the heel fastening system and a step-in mechanism.
Figure 14B:
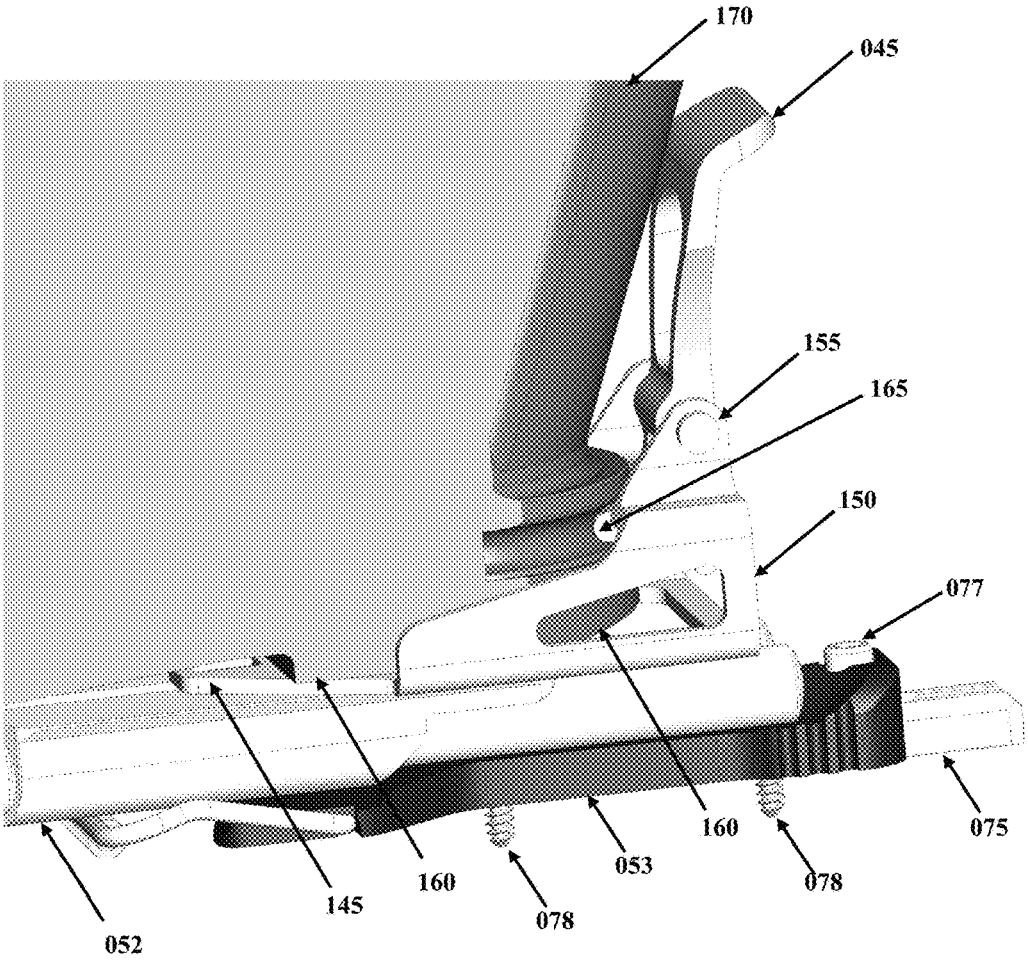
Figure 14C:
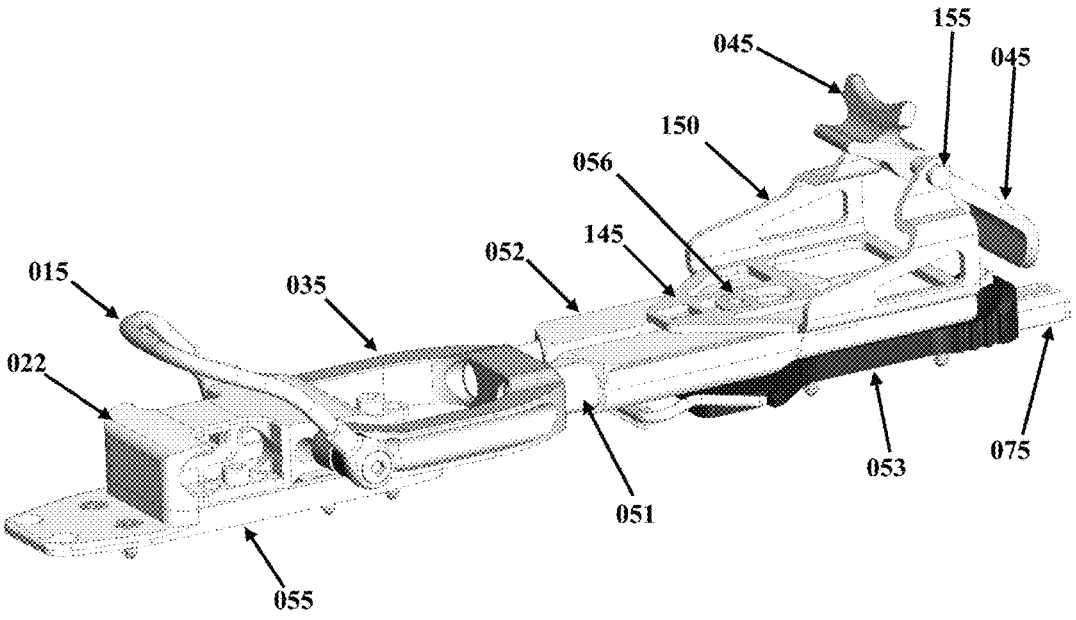
Figure 14D:
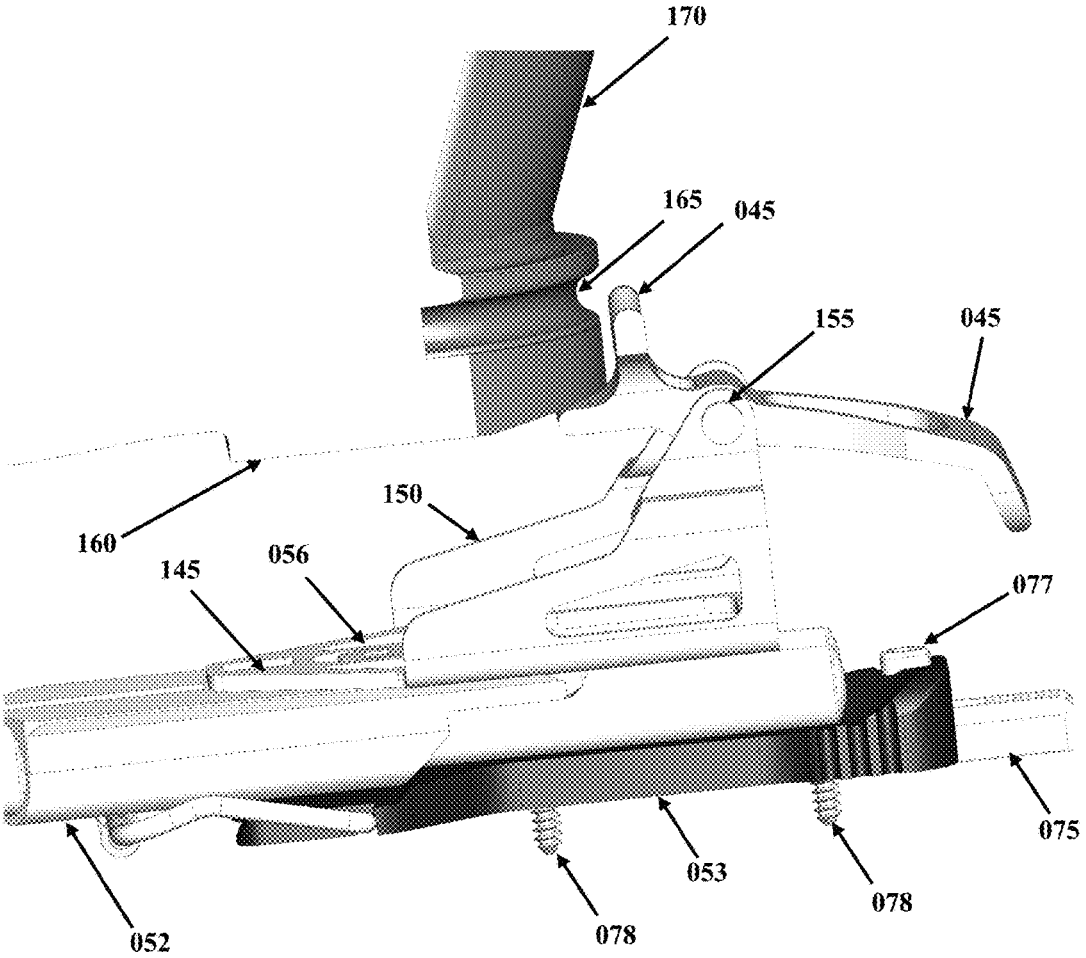

In accordance with another embodiment, the heel fastening mechanism 040 comprises a heel bail 042 mating to the base plate system 032 that further comprises a unique interface of the heel bail 042 to the base plate system 032. The heel dip 045 rotatably attaches to the heel bail 042 and is constrained by the placement of the boot. The heel bail 042, is rigidly connected to a heel lug 043, which is then attached to a shoulder bolt 054 which is rotatably fastened (or by other mechanical fastening means) to the sole block 044. The shoulder bolt 054 can allow the heel lug 043 to freely rotate or can lock the heel lug 043 and thus lock the heel bail 042 in place at a specified angle with respect to the top surface of the sole block 044 to allow a "step in" mechanism for attaching the boot to the binding. FIGS. 14A-D illustrate the embodiment of a step-in mechanism. FIG. 14A illustrates the step-in heel mechanism in the down orientation, and FIG. 14B shows the same orientation as FIG. 14A but with a boot 170 and how the heel of the boot 160 mates with the step-in mechanism. FIG. 14C illustrates the step-in heel mechanism in the up orientation, and FIG. 14D shows the same orientation as FIG. 14C but with a boot 170 and how the heel of the boot 160 mates with the step-in mechanism. In this embodiment with the step-in mechanism, the heel bail 042 is replaced with a step-in heel bail component 150. The step-in heel bail 150 comprises a mating surface 145 that is rigidly connected to the rear case 052 at the fastener 056. The heel clip 045 is configured to mate with and pivot about the step-in heel bail 150 at pin 155. As shown in FIG. 14B, when in the up position, the heel dip 045 mates with boot 170 at boot feature location 165 and the boot heel 165 rests on the step-in heel bail surface 145 while being constrained laterally and medially by the step-in heel bail 150. To release the boot heel 160 from the binding system, as shown in FIG. 14D, the heel clip 045 is orientated in the down position. As the heel dip 045 is rotated about pivot 155 to reach the down position, the boot heel feature 165 is not constrained and no longer mates with the heel clip 045. Then the boot heel 160 is raised off the step-in heel bail feature 145, and thus is not constrained laterally and medially. The heel clip can have indent or ridge features on the distal end that can interface and capture the end of a ski pole to allow the user to easily disengage the step-in system without bending down.

Figure 11:
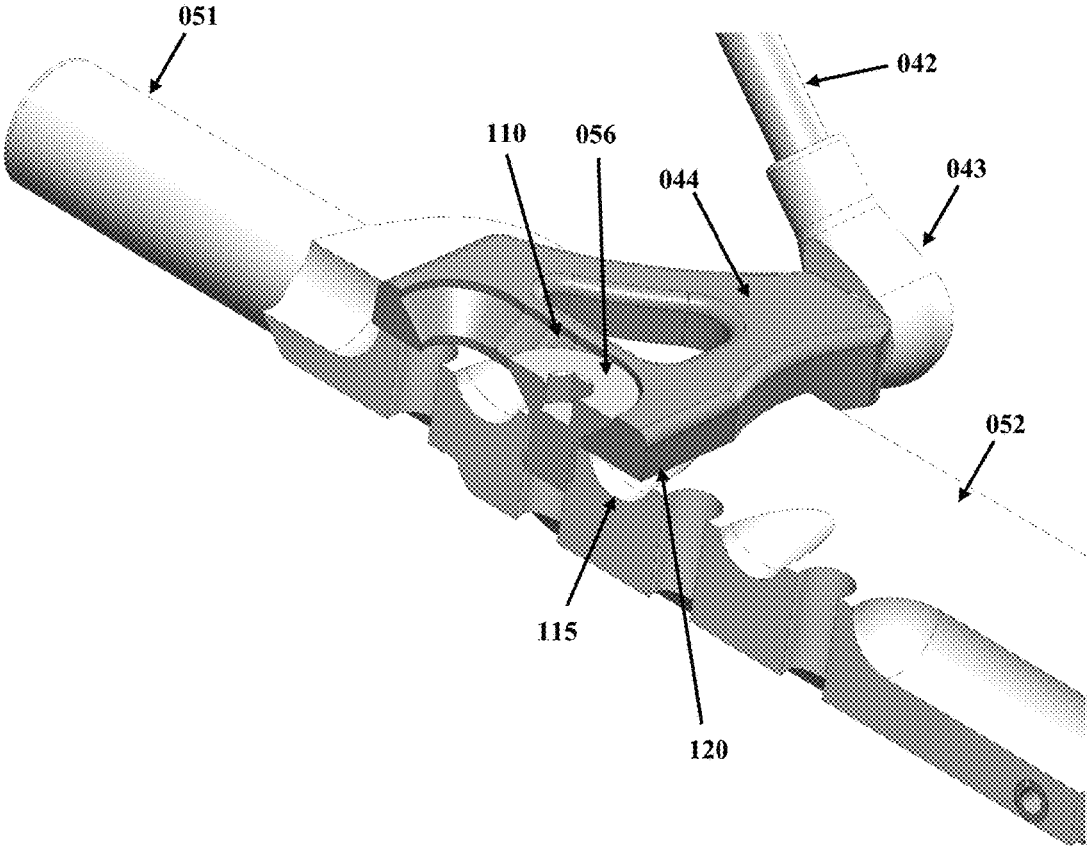
FIG. 11 is a detailed partial cross sectional view of the assembly

The sole block 044 is attached to the rear case 052 through a unique dovetail and scalloped, countersunk holes 110 in the sole block 044 to create a unique index mechanism that allows the sole block 044 to translate longitudinally but is constrained in all other directions. Thus, the sole block 044 may be securely positioned in various places along the rear case to adjust for different boot sizes. The sole block 044 is rigidly secured to the rear case 052 with a mechanical fastener means 056 when the correct boot length is configured. As shown in FIG. 11, the fastener 056 mates with one of plurality of holes in the rear case 052. The head of the fastener 056 locks the sole block 044 position by mating with the countersink feature of the sole block 044 and threading into one of several holes in rear case 052. There are several scalloped features 115 on the rear case 052, and it further constrains the sole block by mating with the sole block end feature 120. This configuration comprises rigid components with high precision rotating joints that increases control because of the ability to transmit both compressive and tensile forces through rigid members. Once a boot is engaged with the heel dip, the boot is locked in place and thus the entire assembly acts as a rigid member.

In accordance with another embodiment, the sliding plate system 030 comprises components that are lightweight without sacrificing performance. For example, the knuckle 035 possesses a contoured surface 036 and cross-section that minimizes the amount of material without compromising strength or rigidity of the knuckle. Therefore, the force transmission through the knuckle is not changed by the reduction in mass. Similarly, the main tube 051 hollow cylindrical shape accomplishing a similar result of minimizing the total mass while maintaining torsional rigidity while maintaining secure contact of the boot to the binding when the heel is in the down position.

In accordance with another embodiment, the main tube 051 is a hollow cylinder and has a longitudinally slotted feature 058 to allow the transfer of forces from the outside surface of the tube to the main springs 090 contained inside the main tube 051 through the rear case pin 095 and other components. Forces from the user move from the rear case assembly to the main springs inside the main tube through the slotted feature. In this embodiment, the rear case pin 095 is used to transfer the force from outside the main tube 051 (the rear case 052) to a spring plug 080 that then transfers the force to the main spring 090 which is captured in the main tube 051 by the tube plug 085. The main tube 051 act as a bearing surface for the rear case 052 and at the same time as a biasing element to always push the rear case 052 forward. The slotted feature 058 also acts as a stop for the longitudinal movement of the rear case 052 on the main tube 051. The load transfer of the base plate system 032 to the main tube 051 creates a stress concentration at the end of the slot feature. The increased wall thickness at location 073 is designed to withstand the stress concentration at the end of the slot feature, thus significantly increasing the main tube strength.

In accordance with another embodiment, the sliding plate system 030 comprises precision bearings for smooth precise travel. The sliding plate system 030 comprises a rear case 052, which further comprises rear case bearings 057 over which the rear case translates at an angle relative to the longitudinal axis of the ski during a "telemark turn". The precise smooth fit of the rear case bearings to the rear case reduce the frictional force and minimize any lateral forces that may reduce the force that is exerted to translate the rear case along the longitudinal axis. The precise fit increases the lateral stiffness of the binding in all positions of the rear case relative to the tubes and during all movements of the system.

Figure 12:
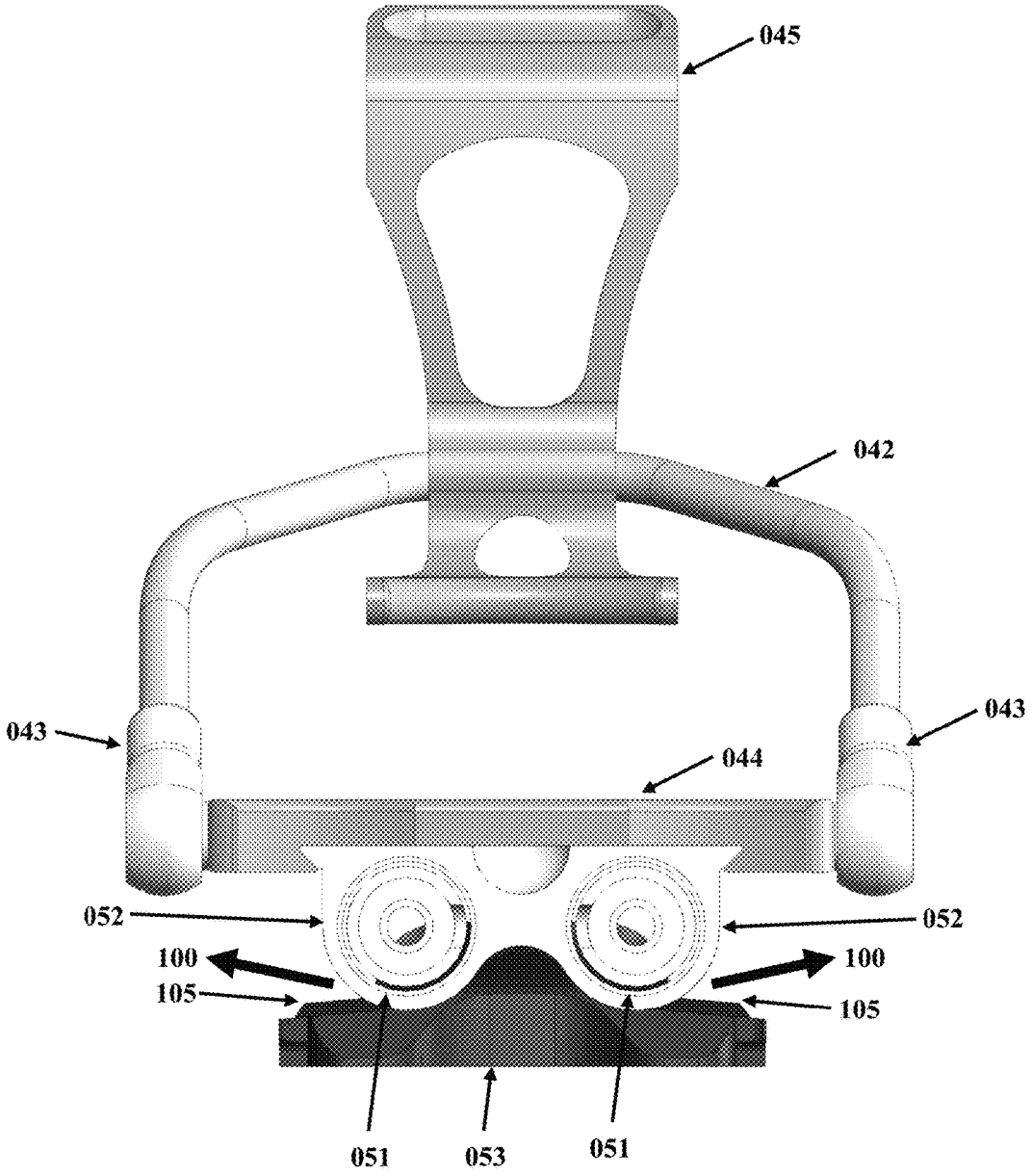
FIG. 12 is a partial side view of the assembly illustrating features that minimize snow accumulation.
Figure 13:
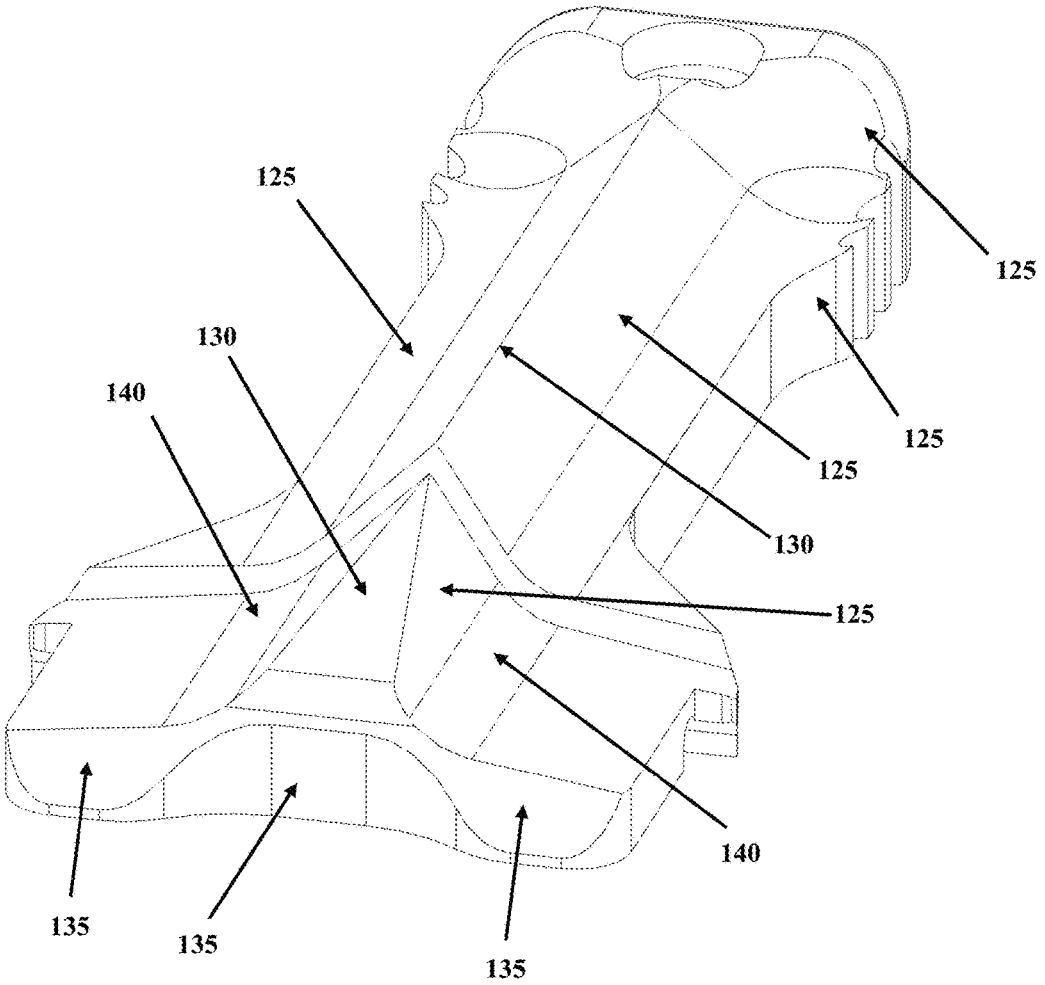
FIG. 13 is an isometric view of the top rail component, illustrating snow accumulation deterrent and removal features of the top rail.

In accordance with another embodiment, the rear case 052 lowers onto the top rail 053 at the location of top rail angled features 105 to remove snow and ice build-up during skiing. FIG. 12 is an end view of the binding in the down position. The rear case 052 mates with the top rail 053 with very limited space between opposing surfaces. The angled features 105 of the top rail push snow and ice out at location 100. FIG. 13 illustrates the contoured surfaces/features of the top rail designed to facilitate the removal of snow and ice during skiing. The front snow cleaning surfaces 135 push the snow forward, away from the binding. The front lateral surfaces 140 assists in pushing the snow from the top front surfaces downward and laterally to the lateral snow cleaning surfaces 125. The lateral snow cleaning surfaces 125 are angled to push snow away from the binding laterally and thus out of the forward movement of the ski. The top surfaces 130 are designed to break through the compacted snow and ice and assist in pushing the snow laterally to the lateral surfaces 125 or completely away from the binding.

Figure 5:
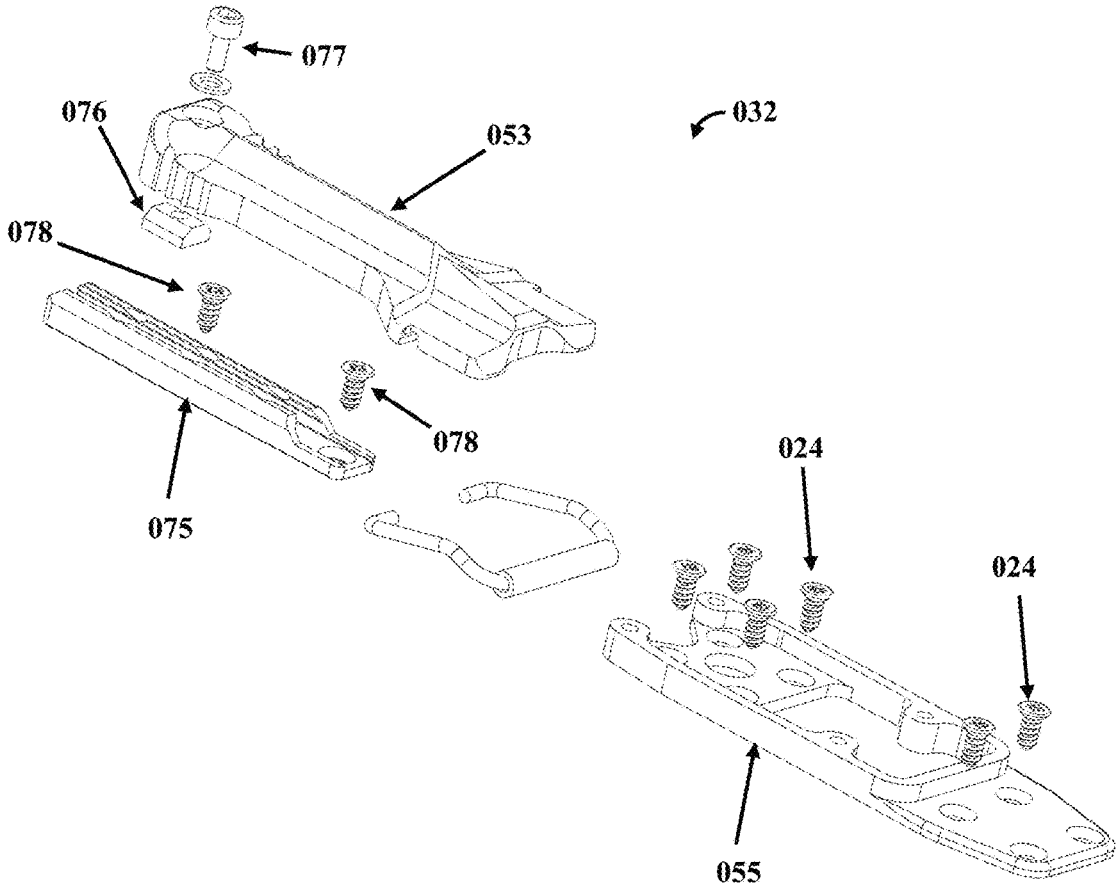
FIG. 5 is a detailed exploded view of the bottom rail and top rail region
Figure 6:
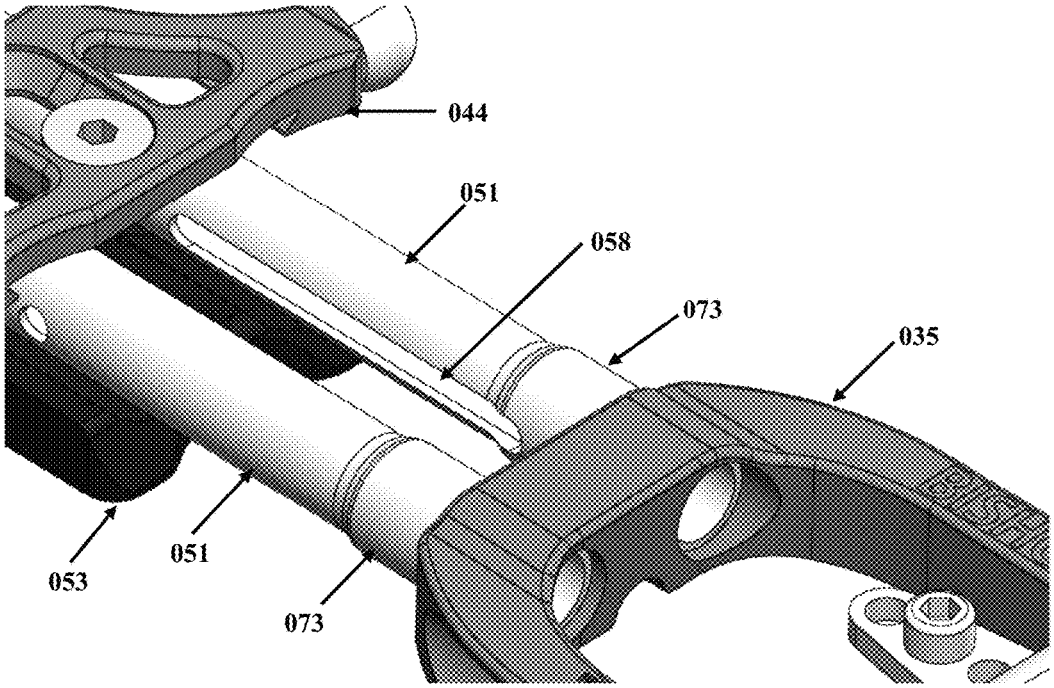
FIG. 6 is a detailed view of the main tube region.
Figure 7:
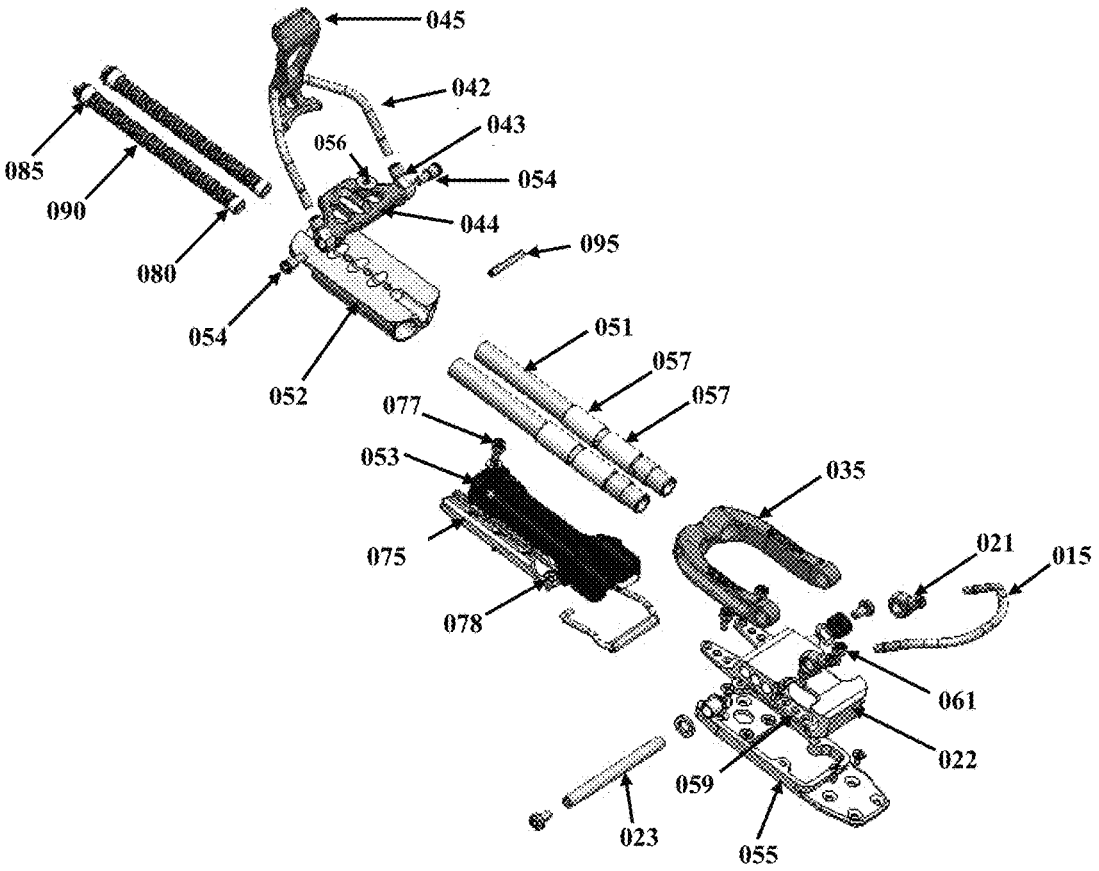
FIG. 7 is an exploded assembly view of the invention.
Figure 8:
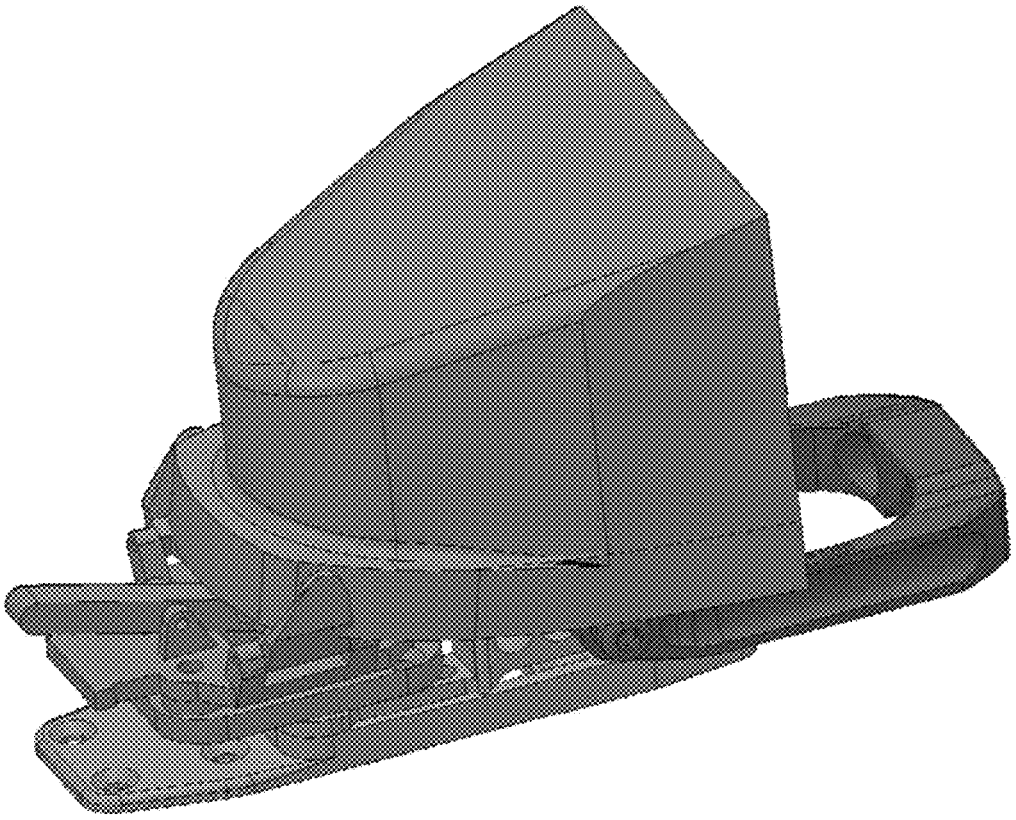
FIG. 8 is an isometric view of the assembly with the tech toe mechanism.
Figure 9:
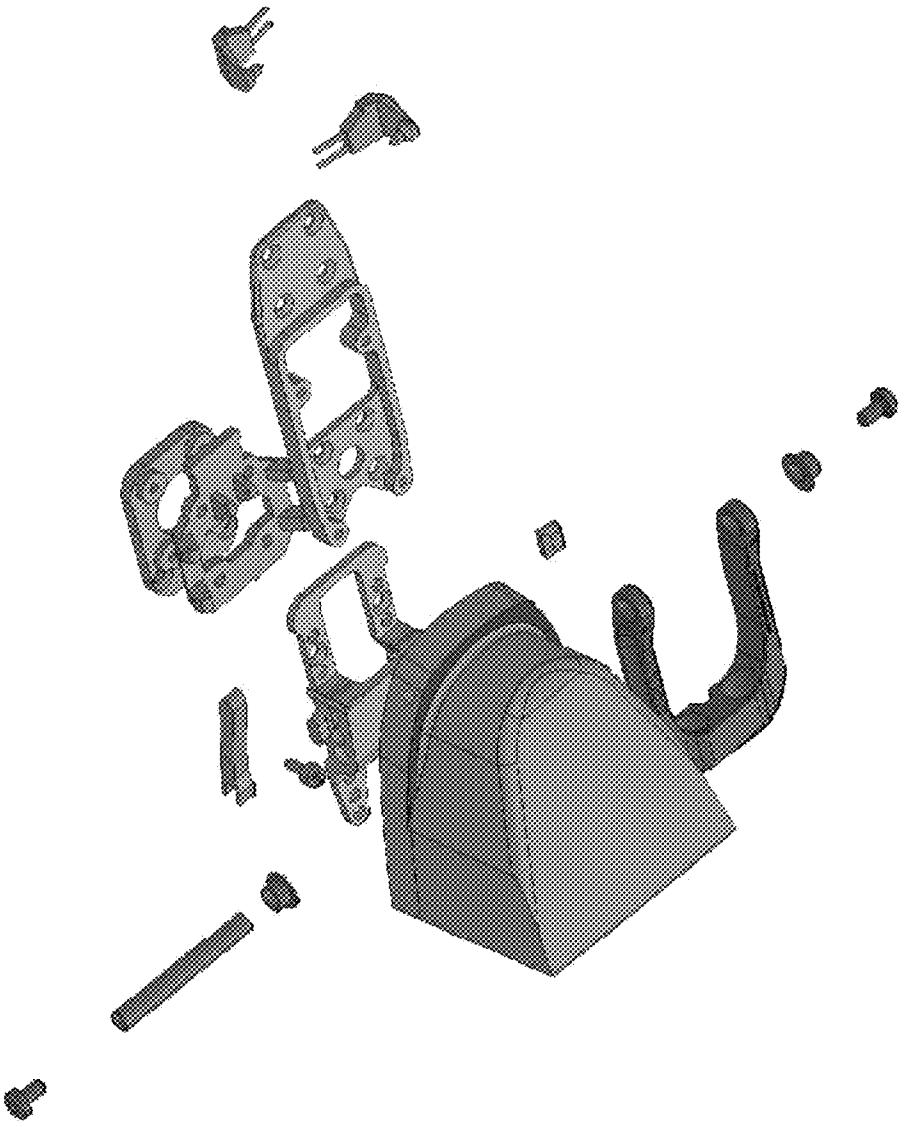
FIG. 9 is an exploded view of the assembly with the tech toe mechanism.

In accordance with another embodiment, the top rail 053 slides longitudinally along the bottom rail 075 and is fixed in place at installation at any position along the length with the rail nut and screw system. The bottom rail 075 has a wedge-type cross sectional geometry that mates with a similar shape of the rail nut 076, as shown in FIG. 5. When the top rail screw 077 is tightened, it wedges the rail nut 076 against the bottom rail 075 and rigidly holds the top rail 053 in the chosen position. The bottom rail 075 is rigidly fixed to the ski by the bottom rail screws 078 or other mechanical fastening means. The top rail 053 can slide along the longitudinal axis of bottom rail 075 and is secured in place when it is in the proper position relative to the rear case 052. This ability to adjust the position of the top rail during installation allows the top rail to fit very closely with the bottom surface of the rear case and thus supply additional lateral and torsional support when the boot and binding is in the down position, and when the bottom of the rear case is resting on the top surface of the top rail. The top rail 053 has a geometry that conforms very closely to the bottom of the rear case 052, and as such can more effectively transfer forces between the back (posterior) of the binding and the ski when the boot is in the down position.

In accordance with another embodiment, the base plate system 032 is fastened to the ski or snowboard and the sliding plate system 030, toe mating mechanism 010, toe plate system 020, and heel fastening system 040 can be easily removed and adjusted independently of the base plate system. This allows the use of multiple base systems that are permanently fastened to the ski or snowboard and a single bindings system to be easily transferred from one set of skis to another. This can reduce the cost by allowing a user to move one pair of bindings from one set of skis to another set of skis that may be more suitable for the current snow conditions. FIG. 5 illustrates the base plate system 032, which includes the base plate 055 which is fastened to the ski by fasteners 024, and the bottom rail 075 fastened to the ski by fasteners 078 as previously described above. The base plate system further includes the top rail 053 and rail nut 076. The top rail 053 slides longitudinally along the bottom rail 075 and is fixed in place at installation at any position along the length with the rail nut and screw system, thus allowing the user to tailor the length to the chosen boot as well as allow for a quick change from ski to ski.

Of course, the foregoing description is that of certain features, aspects and advantages of the present invention, to which various changes and modifications can be made without departing from the spirit and scope of the present invention. Moreover, the telemark binding systems and methods need not feature all of the objects, advantages, features and aspects discussed above. Thus, for example, those skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or sub-combinations of these specific features and aspects of embodiments may be made and still fall within the scope of the invention. Accordingly, it should be understood that various features and aspects of the disclosed embodiments can be combined with or substituted for one another in order to form varying modes of the discussed telemark ski binding systems and methods.

What is claimed is:

1. A telemark ski binding system comprising:

a toe mating mechanism having a toe bail and a knuckle;

a toe block mechanism, the toe bail of said toe mating mechanism is pivotably coupled to said toe block mechanism, the knuckle of said toe mating mechanism is pivotably coupled to said toe block mechanism, said toe bail and knuckle pivotal on the same axis;

a base plate system having a base plate, said base plate adjustably and detachably engageable with said toe block mechanism; and a rear case, said rear case engageable to couple to said base plate system;

a rail forming a part of said base plate system, wherein during operation of the telemark ski binding system, said rear case lowers onto the rail;

a main tube coupled to said rear case;

wherein the rear case translates along a longitudinal axis of the main tube and is constrained from translating laterally with respect to the main tube; and wherein the rear case comprises a precision bearing surface that mates with the main tube, the precision bearing surface delimits an interior cylindrical hollow, said hollow in a portion of the rear case and said precision bearing surface slides over the main tube when the rear case translates along the longitudinal axis.

2. A telemark ski binding system comprising:

a toe mating mechanism having a toe bail and a knuckle;

a toe block mechanism, the toe bail of said toe mating mechanism is pivotably coupled to said toe block mechanism, the knuckle of said toe mating mechanism is pivotably coupled to said toe block mechanism, said toe bail and knuckle pivotal on the same axis;

a base plate system having a base plate, said base plate adjustably and detachably engageable with said toe block mechanism; and a rear case, said rear case coupled to said toe block mechanism;

a rail forming a part of said base plate system, wherein during operation of the telemark ski binding system, said rear case lowers onto the rail a heel fastening mechanism which constrains a heel laterally and torsionally when the heel is coupled to the telemark ski binding system, a sole block coupled to said heel fastening mechanism;

said rear case coupled to said sole block;

a main tube coupled to said rear case;

wherein the rear case translates along a longitudinal axis of the main tube and is constrained from translating laterally with respect to the main tube;

wherein when the base plate system is connected to a ski, the telemark ski binding system transfers torsional and rotational forces generated at the heel, when the heel is coupled to the telemark ski binding system; and wherein the rear case comprises a precision bearing surface that mates with the main tube, the precision bearing surface delimits an interior cylindrical hollow, said hollow in a portion of the rear case, and said bearing surface slides over the main tube when the rear case translates along the longitudinal axis.

3. The heel fastening mechanism of claim 2, further comprising:

a heel bail component; and a heel clip component;

wherein the heel bail is connected to the sole block and at an angle with respect to a surface of the sole block; and wherein the heel clip is rotatably attached to the heel bail.

4. The telemark binding system of claim 3, wherein the sole block further comprises:

a rigid connection to the rear case which is rigidly connected to the heel mating mechanism; and a dovetail mechanism that allows translation only in the longitudinal direction.

5. A telemark ski binding system comprising:

a base plate system;

a heel fastening mechanism which constrains a heel laterally and torsionally when the heel is coupled to the telemark ski binding system, a sole block;

a rear case;

a main tube;

wherein the heel fastening mechanism is rigidly connected to the sole block;

wherein the sole block is rigidly connected to the rear case and the rear case is coupled to a toe block;

wherein the rear case translates along a longitudinal axis of the main tube and is constrained from translating laterally with respect to the main tube;

wherein when the base plate system is connected to a ski, the telemark ski binding system transfers torsional and rotational forces generated at the heel to the ski when the heel is coupled to the telemark ski binding system; and wherein the rear case further comprises a precision bearing surface that mates with the main tube, the precision bearing surface delimits an interior cylindrical hollow, said hollow in a portion of the rear case, and said rear case slides over the main tube when the rear case translates along the longitudinal axis.

6. A telemark ski binding system comprising:

a base plate system;

a heel fastening mechanism which constrains a heel laterally and torsionally when the heel is coupled to the telemark ski binding system, a sole block;

a rear case;

a main tube; and wherein the heel fastening mechanism is rigidly connected to the sole block;

wherein the sole block is rigidly connected to the rear case and the rear case is coupled to the toe block;

wherein the rear case translates along a longitudinal axis of the main tube and is constrained from translating laterally with respect to the main tube;

wherein when the base plate system is connected to a ski, the telemark ski binding system transfers torsional and rotational forces generated at the heel to the ski, when the heel is coupled to the telemark ski binding system; and wherein the rear case further comprises a precision bearing surface that mates with the main tube, the precision bearing surface delimits an interior cylindrical hollow, said hollow in a portion of the rear case, and said rear case slides over the main tube when the rear case translates along the longitudinal axis.

7. The heel fastening mechanism of claim 5, further comprising:

a heel bail; and a heel clip;

wherein the heel bail is rigidly connected to the sole block at an angle with respect to a surface of the sole block that is parallel to the ski; and wherein the heel clip is rotatably attached to the heel bail.

8. The telemark binding system of claim 7, wherein the sole block further comprises:

a rigid connection to the rear case which is rigidly connected to the heel fastening mechanism; and a dovetail mechanism that allows translation only in the longitudinal direction.

9. The telemark ski binding system of claim 2, further comprising;

a bottom rail;

wherein the rail is a top rail and the top rail slides longitudinally along the bottom rail; and wherein the top rail is fixed in place at any one location of a plurality of positions during installation; and wherein the bottom rail is rigidly connected to the ski.

10. A telemark ski binding system comprising:

a base plate system;

a heel fastening mechanism which constrains a heel laterally and torsionally when the heel is coupled to the telemark ski binding system;

a sole block;

a rear case;

a main tube; and wherein the heel fastening mechanism is connected to the sole block;

wherein the sole block is rigidly connected to the rear case and the rear case is coupled to a toe block;

wherein the rear case translates along a longitudinal axis of the main tube and is constrained from translating laterally with respect to the main tube;

wherein when the base plate system is connected to a ski, the telemark ski binding system transfers torsional and rotational forces generated at the heel to the ski, when the heel is coupled to the telemark ski binding system; and said telemark binding further comprising:

a compression spring contained within a cylindrical hollow of the main tube;

wherein the rear case has a cylindrical inner cavity feature and the inner cavity feature concentrically aligns with the main tube outer diameter;

wherein the main tube is configured as a hollow cylinder and the hollow cylinder has a longitudinally slotted feature wherein forces from the rear case are transferred to the compression spring through the slotted feature.

* * * * *